US005813946A

United States Patent [19]

Lin et al.

[11] Patent Number: 5,813,946

[45] Date of Patent: Sep. 29, 1998

[54] INFLATABLE JUMPING TOY AND METHOD

[75] Inventors: Hua Hsiang Lin, Kowloon; Yaw-Yuan Hsu; Yu-Fu Hsiao, both of Fuzhou, all of Hong Kong; Richard A. Saputo, Long Beach, Calif.

[73] Assignee: Intex Recreation Corp., Long Beach, Calif.

[21] Appl. No.: 674,620

[22] Filed: Jul. 3, 1996

Related U.S. Application Data

[63] Continuation-in-part of Ser. No. 45,210, Oct. 12, 1995, abandoned.

[51] Int. Cl.[6] ..... A63B 5/11

[52] U.S. Cl. ..... 482/27; 482/77; 47/135

[58] Field of Search ..... 482/77, 27, 135; 472/126; 446/220, 221; 5/449, 455, 99.1, 98.1; 52/2.11, 2.22; 441/40, 41

[56] References Cited

U.S. PATENT DOCUMENTS

| | | | |
|---|---|---|---|
| 1,738,411 | 12/1929 | Welch | 482/132 |
| 4,815,153 | 3/1989 | Bleser et al. | 5/98 R |
| 4,817,935 | 4/1989 | Varga | 472/126 |
| 4,935,970 | 6/1990 | Aristone | 472/126 |
| 5,575,738 | 11/1996 | Millington et al. | 482/27 |

*Primary Examiner*—Jerome Donnelly
*Attorney, Agent, or Firm*—Lewis, D'Amato, Brisbois & Bisgaard

[57] ABSTRACT

An inflatable jumping toy typically employed in a play area by children performing jumping exercises is disclosed. The inflatable jumping toy comprises a construction incorporating a large torodial-shaped tube utilized as a base element and a vertical retainer wall mounted upon the top of the torodial-shaped tube. The retainer wall functions to absorb the lateral impact of a child against the jumping toy and to prevent a child from falling out of or being accidentally ejected from the jumping toy. A multi-layer bouncing mattress which is surrounded by and in communication with the torodial-shaped tube serves as a cushioned floor to absorb the vertical impact of the children during the jumping exercises. In a preferred embodiment, the multi-layer bouncing mattress includes an upper floor layer having an I-beam construction for providing maximum impact absorption of the vertical forces associated with jumping. Beneath the upper I-beam layer is a lower floor layer comprising a single X-beam spiral construction which enjoys strong welded seals about one continuous spiral air chamber which promotes the passage of inflation air therethrough. As an alternative, a parallel X-beam constructed layer can be used as the lower floor layer. Either lower floor layer provides a robust, wear-resistant surface for indoor or outdoor use.

19 Claims, 12 Drawing Sheets

INFLATABLE JUMPING TOY AND METHOD

This application is a continuation-in-part of the patent application Ser. No. 29/045,210 filed on Oct. 12, 1995, now abandoned and entitled Inflatable Jumping Toy Design.

BACKGROUND OF THE INVENTION

1. Field of the Invention:

The present invention generally relates to inflatable toys, and more particularly relates to an inflatable jumping toy having a vertical retainer wall mounted upon a torodial base tube which incorporates a multi-layer bouncing mattress utilized to support the weight of children during jumping exercises on the bouncing mattress.

2. Description of the Related Art:

Inflatable toys and devices, which are popular with small children, are available in the marketplace. Many of these inflatable toys are designed for use in water including wading and swimming pools for small children.

In the absence of water, wading and swimming pools and many other inflatable water toys cease to be a danger but no longer serve the function that they were designed for. Inflatable toys not intended to be utilized with water would eliminate most hazards to small children associated with wading and swimming pools. However, wading and swimming pool type toys usually attract the attention of small children.

Another type of inflatable toy which attracts the attention of small children comprises a surface for children to play and bounce on. Typically, the bouncing or play surface of the inflatable toy is the top layer of an inflatable balloon or mattress which is somewhat convex because of the pressure of the inflation medium. Thus, the bouncing or play surface is only semi-level and thus presents a challenge to walk across and presents a potential danger.

An inflatable toy as described in the preceding paragraph is utilized in a manner similar. to a trampoline. One example of such an inflatable toy includes a large heavy duty inflatable balloon or mattress equipped with a compressor which cycles periodically to maintain the pressure within the inflatable mattress. The inflatable toy often includes a cover housing formed of mesh which is employed to prevent small children from falling off of a bouncing surface on the top of the inflatable mattress. Unfortunately, this type of inflatable toy is extremely large and impractical for regular use by small children in or around the home.

Pool shaped inflatable toys not intended to be used with water have also been known in the past. A representative inflatable toy is comprised of vinyl and includes a circular jumping surface surrounded by a retaining wall. Both the jumping surface and retaining wall are inflated with air. The jumping surface supports the weight of a child and the retaining wall inflates to approximately 16" from the jumping surface.

Unfortunately, if the pool shaped inflatable toys of the prior art are not properly inflated, they can become unstable and cause a child to fall or bounce out and be injured. This occurs particularly when the jumping surface is over-inflated. Thus, proper inflation of the pool shaped inflatable toys of the past is critical. Furthermore, the pool shaped inflatable toys should always be positioned for use upon an impact absorbing surface such as sand or mulch if used outdoors or on a padded surface if used indoors. Use of the pool shaped inflatable toys of the prior art should never occur on hard surfaces since injuries can occur. Further, prior art inflatable toys also have been known to be unstable during use.

Thus, there is a need in the art for an inflatable jumping toy which is comprised of durable material such as vinyl and includes a vertical retainer wall mounted upon a wide torodial base tube, a seating shelf and a bouncing mattress comprised of an upper impact-absorbing section and a separate bottom section which exhibits strong seals, each of which are charged with air.

SUMMARY OF THE INVENTION

Briefly, and in general terms, the present invention provides a new and improved inflatable jumping toy and method therefore embodying a novel apparatus having a multi-layer bouncing mattress surrounded by a torodial base tube and a vertical retainer wall for protecting children against injury while using the inflatable toy for jumping exercises.

The present invention is generally directed to an inflatable jumping toy and method therefore and is typically employed in a play area by children performing jumping exercises. The inflatable jumping toy comprises a construction incorporating a large torodial-shaped tube utilized as a base element and a vertical retainer wall mounted upon the top of the torodial-shaped tube. The retainer wall functions to absorb the lateral impact of a child against the jumping toy and to prevent a child from falling out of or being accidentally ejected from the jumping toy. A multi-layer bouncing mattress which is surrounded by and in communication with the torodial-shaped tube serves as a cushioned floor to absorb the vertical impact of the children during the jumping exercises and affords greater stability.

In a preferred embodiment, the inflatable jumping toy exhibits durable vinyl construction and includes six separate air chambers each having double air valves. The torodial base tube is designed to have a wide dimension to provide vertical and lateral stability to the jumping toy. The torodial base tube is physically attached to the vertical retainer wall by a connection web having drains holes formed therein to prevent water accumulation within the jumping toy. The retainer wall is comprised of three separate tubular air chambers stacked one upon the other to provide extra protection.

In the preferred embodiment, the multi-layer bouncing mattress of the inflatable jumping toy serves as a cushioned floor to absorb vertical impact during jumping exercises. This is accomplished by providing an upper floor layer having I-beam construction for providing maximum impact absorption of the vertical forces associated with jumping. Beneath the upper I-beam layer is a lower floor layer comprising a single X-beam spiral construction. The single X-beam spiral construction enjoys strong seal protection since the spiral construction has one long air chamber which promotes the passage of inflation air therethrough thus providing absorption of energy which might break the seals.

As an alternative, the lower single X-beam spiral layer can be replaced with a parallel X-beam constructed layer which is mounted beneath the upper I-beam constructed layer. Under these conditions, the feature of providing maximum impact absorption of the vertical forces associated with jumping is retained. However, use of either of the single X-beam spiral constructed layer or the parallel X-beam constructed layer results in a robust, wear-resistant lower floor layer for either indoor or outdoor use.

These and other objects and advantages of the present invention will become apparent from the following more detailed description, taken in conjunction with the accompanying drawings which illustrate the invention, by way of example.

DESCRIPTION OF THE PREFERRED EMBODIMENT

Figure 1:
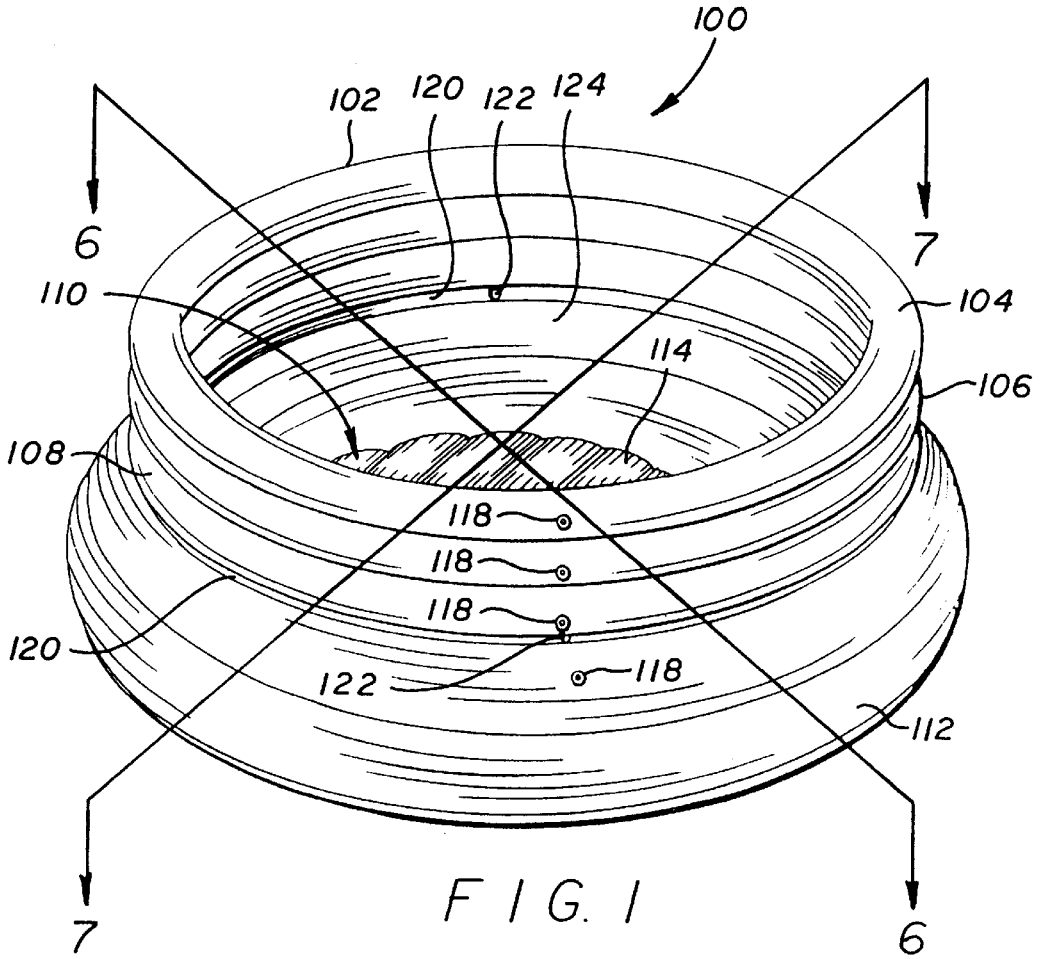
FIG. 1 is a front top perspective view of a preferred embodiment of the inflatable jumping toy of the present invention showing a vertical retainer wall comprised of stacked rings mounted upon a torodial base tube.

Referring now to the drawings, and particularly to FIG. 1, there is shown a front top perspective view of an inflatable jumping toy 100. The jumping toy 100 is typically employed in an indoor and/or outdoor play area for use by children. The jumping toy 100 is used in a manner similar to that of a trampoline in that it is employed for jumping exercises.

In a preferred embodiment, the jumping toy 100 is comprised of durable high molecular weight vinyl construction and includes a vertical retainer wall 102 comprised of a plurality of stacked rings including a top ring 104, a middle ring 106 and a bottom ring 108. The stacked rings 104, 106 and 108 are tubular in shape and are mounted one directly above the other. However, it is understood that the shape of the stacked rings 104, 106 and 108 is not limited to tubular. Further, the stacked rings 104, 106 and 108 are sealed together as best shown in FIGS. 6–9 and also in FIGS. 2–3 in a manner known in the art. A suitable method of sealing is dialectric radio frequency (RF) sealing using a die and platen combination (not shown). The cross-sectional views of FIGS. 8 and 9 clearly indicate the sealed nature of the three stacked rings 104, 106 and 108.

Children use the jumping toy 100 to perform jumping exercises. To this end, a child enters the jumping toy 100 by scaling the retainer wall 102. Once inside the jumping toy 100, the jumping exercises can be executed upon a bouncing mattress 110 clearly shown in FIGS. 1, 4 and 6–9. The function of the retainer wall 102 is two fold. Initially, the retainer wall 102 serves as a safety cushion during jumping exercises to protect the child during accidental collisions with the vertical retainer wall 102. More importantly, the retainer wall 102 is designed to prevent a child from falling out of or being accidentally ejected from the jumping toy.

Six separate air chambers are built into the preferred embodiment of the inflatable jumping toy 100 of the present invention. Three of the six air chambers are provided by the three stacked tubular rings of the vertical retainer wall 102, e.g., the top ring 104, the middle ring 106 and the bottom ring 108. Thus, the retainer wall 102 is comprised of three stacked tubular rings which form three separate air chambers. The remaining three air chambers are provided by a torodial base tube 112 shown in FIGS. 1–9, an upper layer 114 of the bouncing mattress 110 shown in FIGS. 4 and 6–9 and a lower layer 116 of the bouncing mattress 110 shown in FIGS. 5 and 6–9. Further, each air chamber is fitted with a Double-Value 118 to retain the air within the respective air chamber as is shown in FIGS. 1–2 and 4–5. It is noted that each of the six separate air chambers formed within the jumping toy 100 can be inflated with a common toy inflating pump.

Figure 2:
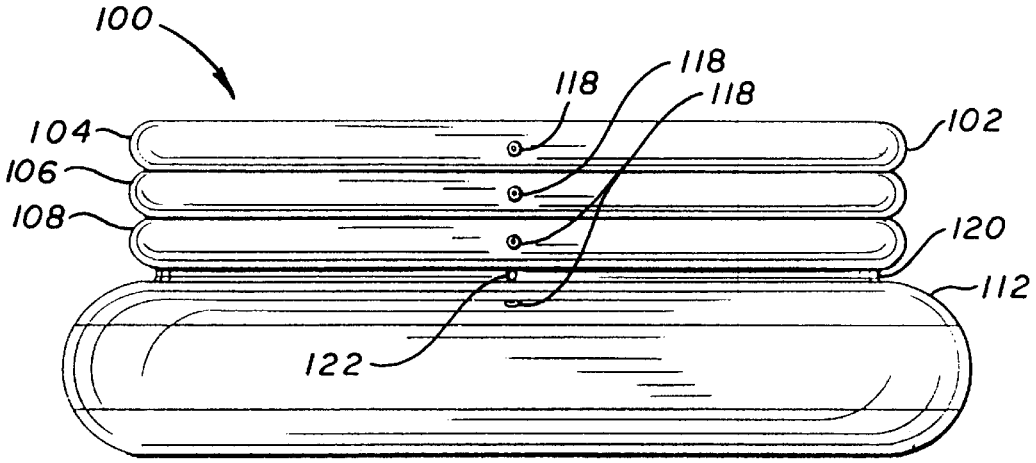
FIG. 2 is a front elevational view of the inflatable jumping toy of FIG. 1 showing an air valve mounted in each of the stacked rings of the retainer wall and in the torodial base tube.
Figure 3:
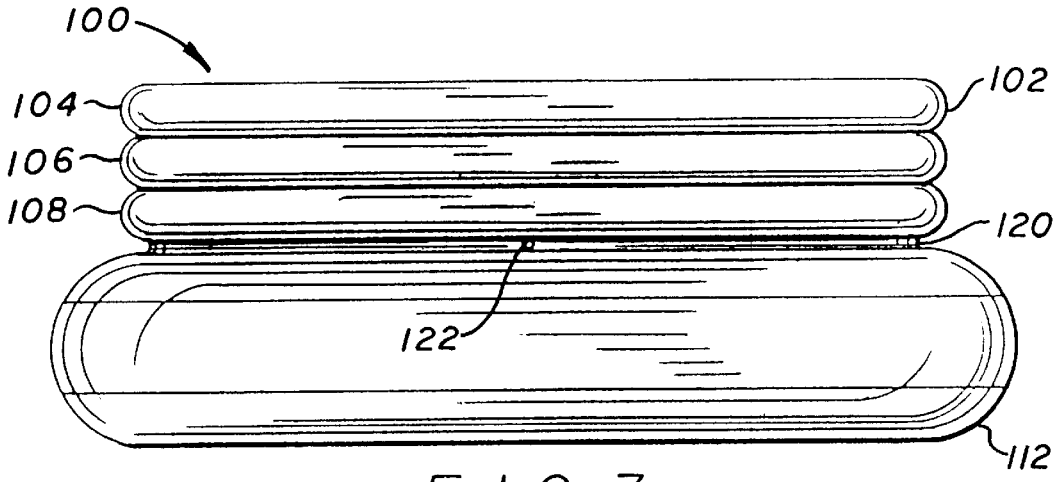
FIG. 3 is a rear elevational view of the inflatable jumping toy of FIG. 1 showing a drain hole formed in a connection web positioned between the retainer wall and the torodial base tube.

The vertical retainer wall 102 is mounted upon the torodial base tube 112 as best shown in FIGS. 6–9 and also in FIGS. 2–3. The physical connection between the retainer wall 102 and the torodial base tube 112 is accomplished by utilizing a connection web 120 comprised of durable vinyl construction.

Figure 8:
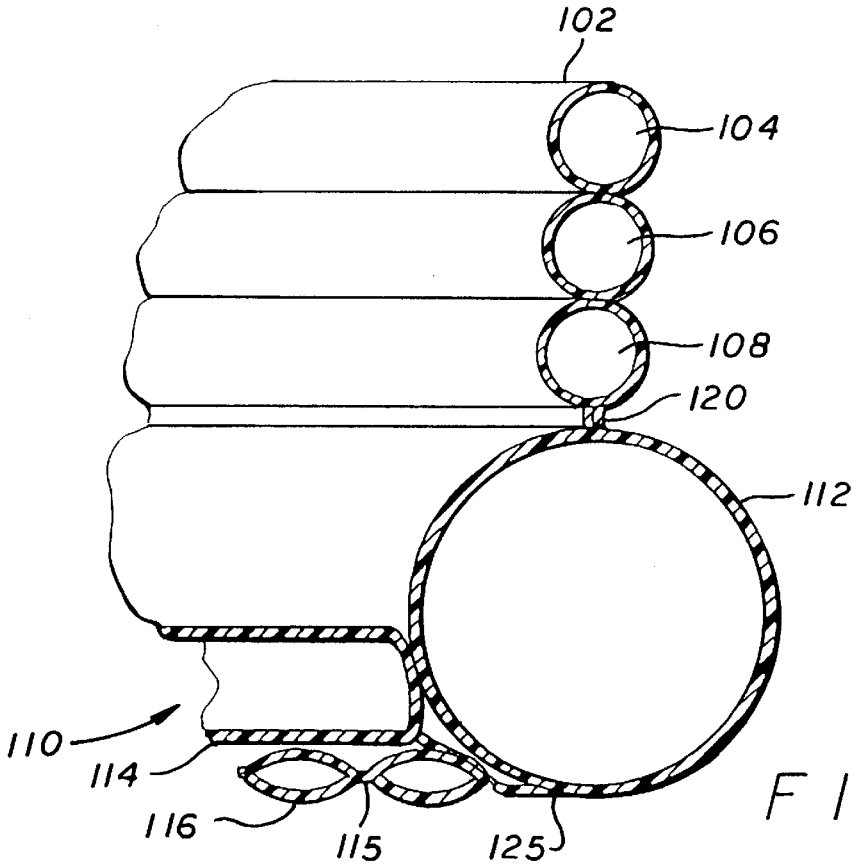
FIG. 8 is an enlarged detail drawing of the retainer wall, torodial base tube and the upper and lower layers of the bouncing mattress shown in FIG. 6.
Figure 9:
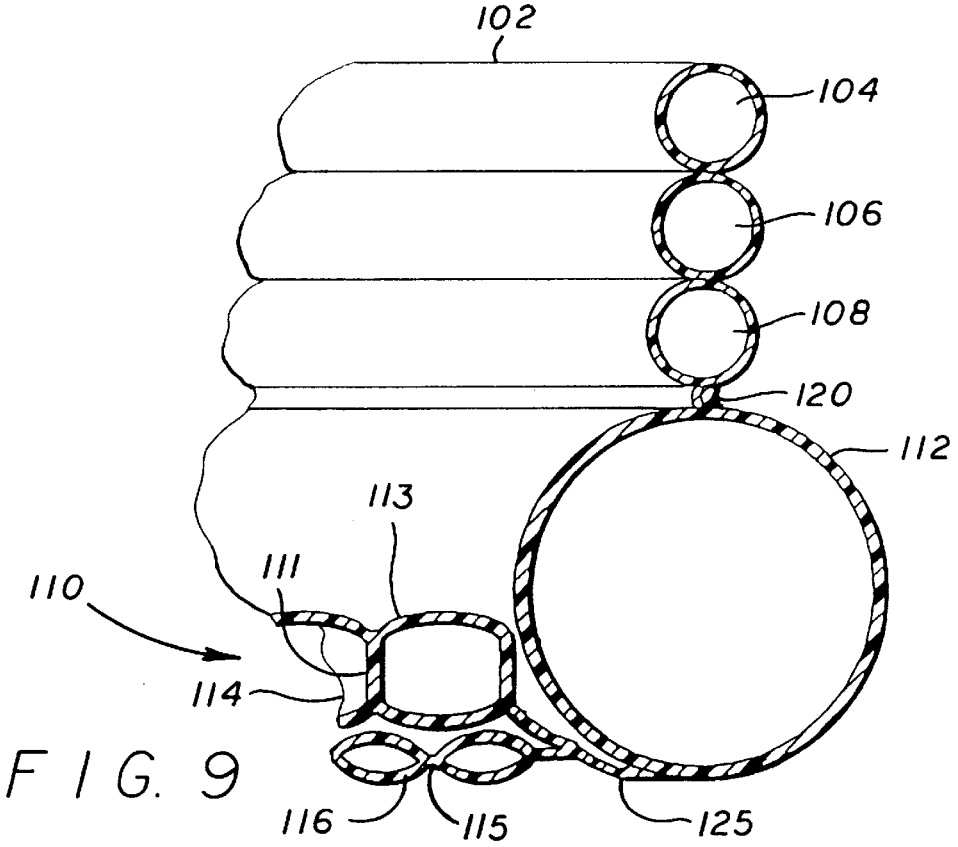
FIG. 9 is an enlarged detail drawing of the retainer wall, torodial base tube and the upper and lower layers of the bouncing mattress shown in FIG. 7.

The connection web 120 is clearly shown in FIGS. 8 and 9 as connecting the bottom stacked ring 108 to the top surface of the torodial base tube 112. This attachment by connection web 120 can be accomplished in any suitable manner such as by RF sealing so that the vertical retainer wall 102 is rigidly connected to the torodial base tube 112.

In order to prevent water accumulation within the volume bounded by the torodial base tube 112 and the upper layer 114 of the bouncing mattress 110, drain holes 122 are formed along the retainer wall 102 such as, for example, within the connection web 120. Drain holes 122 are shown formed within the connection web 120 in FIGS. 1–3 and are also necessary to prevent the jumping toy 100 from being utilized as a pool. It is to be understood that the number and location of drain holes is 122 can be changed.

The torodial base tube 112 is a large donut-shaped tubular structure fashioned from heavy duty vinyl construction. The function of the torodial base tube 112 is to serve as the base support structure to provide stability to the jumping toy 100. The torodial base tube 112 of the preferred embodiment of the present invention inflates to 82" (e.g., to 6' 10" or 208 cm) to provide extra stability to the jumping toy 100. As can be seen in FIGS. 6–9, the torodial base tube 112 is larger than the tubular stacked rings 104, 106 and 108. The torodial base tube 112 easily supports the stacked rings 104, 106 and 108 and extends further outward and inward than the retainer wall 102 as is clearly illustrated in FIGS. 8 and 9.

Figure 4:
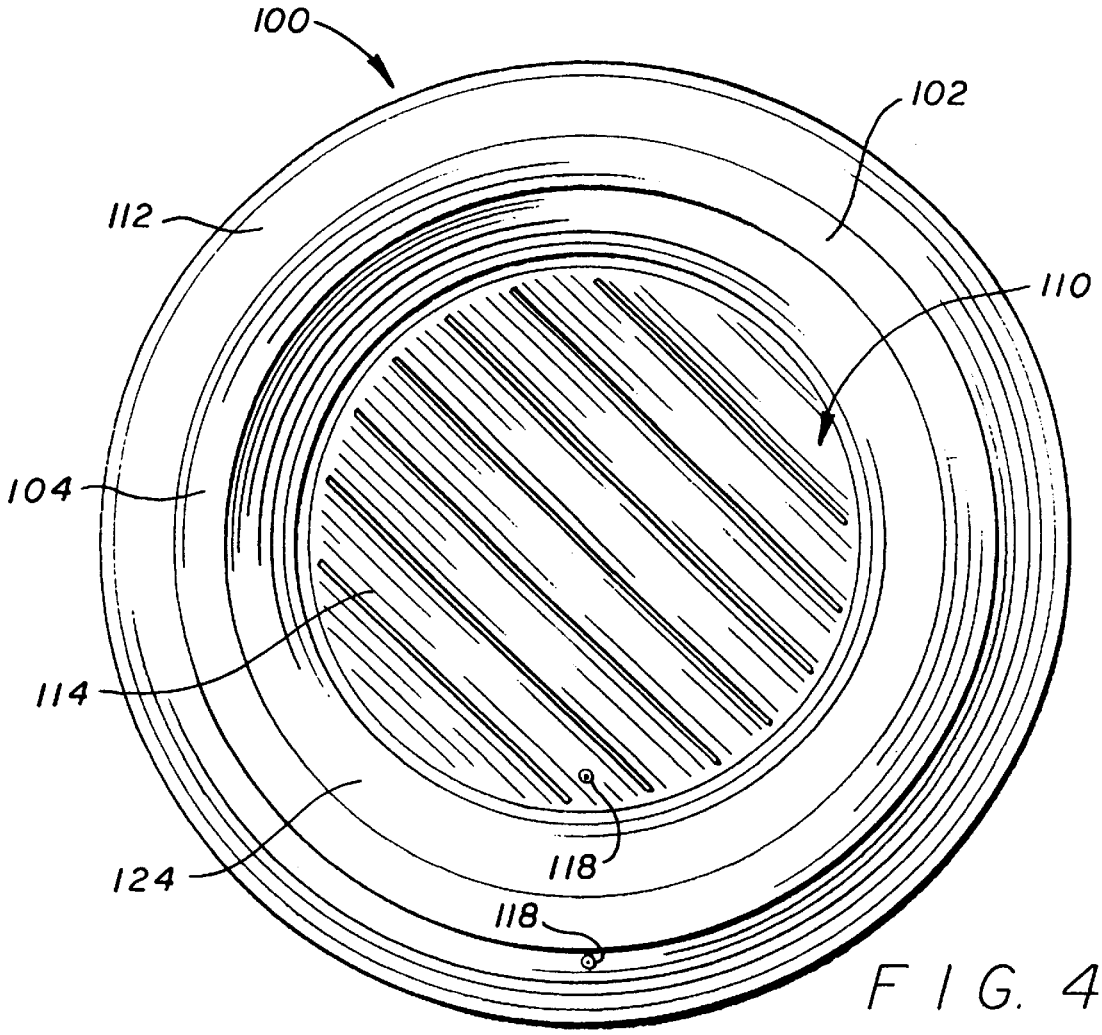
FIG. 4 is a top planar view of the inflatable jumping toy of FIG. 1 showing the retainer wall mounted over the torodial base tube and a circular seating shelf extending inward from the retainer wall to the outer perimeter of the upper layer of a bouncing mattress positioned within the torodial base tube.

The torodial base tube 112 is open in the center portion thereof which provides the situs of the bouncing mattress 110 and which serves as the floor of the jumping toy 100. A seating shelf 124 extends from the torodial base tube 112 as shown in FIGS. 1 and 4. While standing on the bouncing mattress 110 within the periphery of the jumping top 100, it can be seen that the seating shelf 124 extends into the volume encompassed by the torodial base tube 112. The torodial base tube 112 can be manufactured to include the seating shelf 124 as a portion of the structure thereof. In the alternative, the seating shelf 124 can be manufactured as an extension of the torodial base tube 112. In either case, the seating shelf 124 is charged with air pressure so that it can be utilized as a resting place for children using the jumping toy 100. The seating shelf 124 is not shown in FIGS. 6–9 so that the relationship among the retainer wall 102, the torodial base tube 112 and the bouncing mattress 110 can be illustrated.

The bouncing mattress 110 supports the weight of the children and is the medium that provides energy which assists in propelling the children upward during the jumping exercises. The bouncing mattress 110 comprises two sections or layers, e.g., the upper layer 114 which serves as a floor for the jumping toy 100 and upon which the children stand and the lower layer 116 which is positioned immediately below the upper layer 114 and contacts the supporting surface (not shown) underneath the jumping toy 100. In the preferred embodiment, the upper layer 114 of the bouncing mattress 110 comprises an I-beam construction as shown best in FIGS. 7 and 9 and 4. However, the lower layer 116 of the bouncing mattress 110 comprises a single X-beam spiral construction as shown best in FIGS. 6–9 and FIG. 5. Both the I-beam construction and the single X-beam spiral construction are known in the prior art for use in inflatable devices. Both the upper layer 114 and the lower layer 116 of the bouncing mattress 110 are bonded together and to the bottom of the torodial base tube 112 as by RF sealing at a connection point 125 as shown in FIGS. 6–9.

Figure 6:
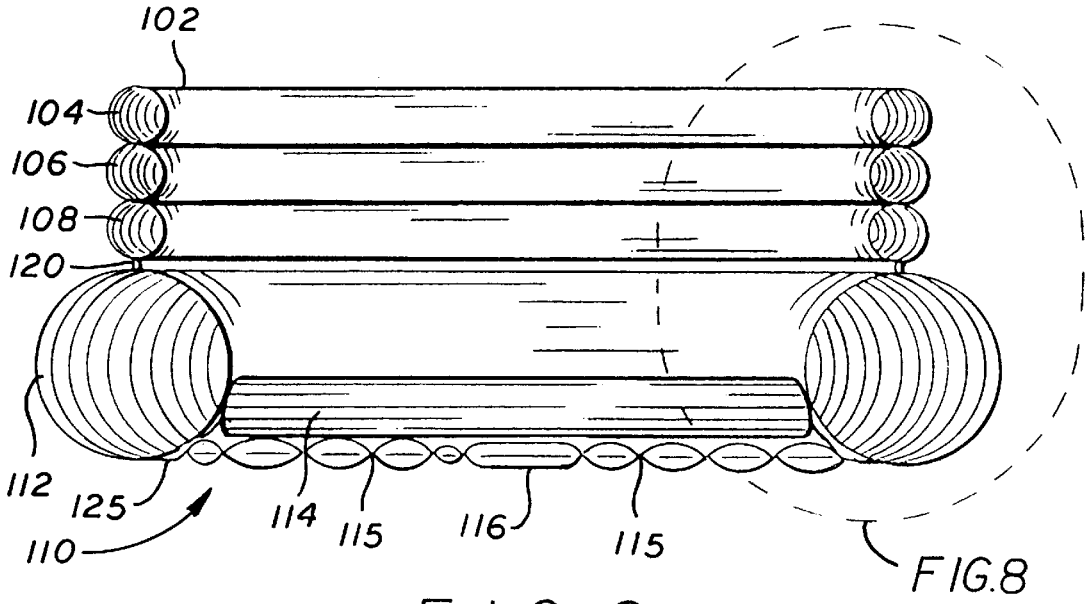
FIG. 6 is a cross-sectional view of the inflatable jumping toy taken along the line 6—6 of FIG. 1 showing the stacked rings of the retainer wall, the torodial base tube and the single X-beam spiral shaped lower layer of the bouncing mattress.
Figure 7:
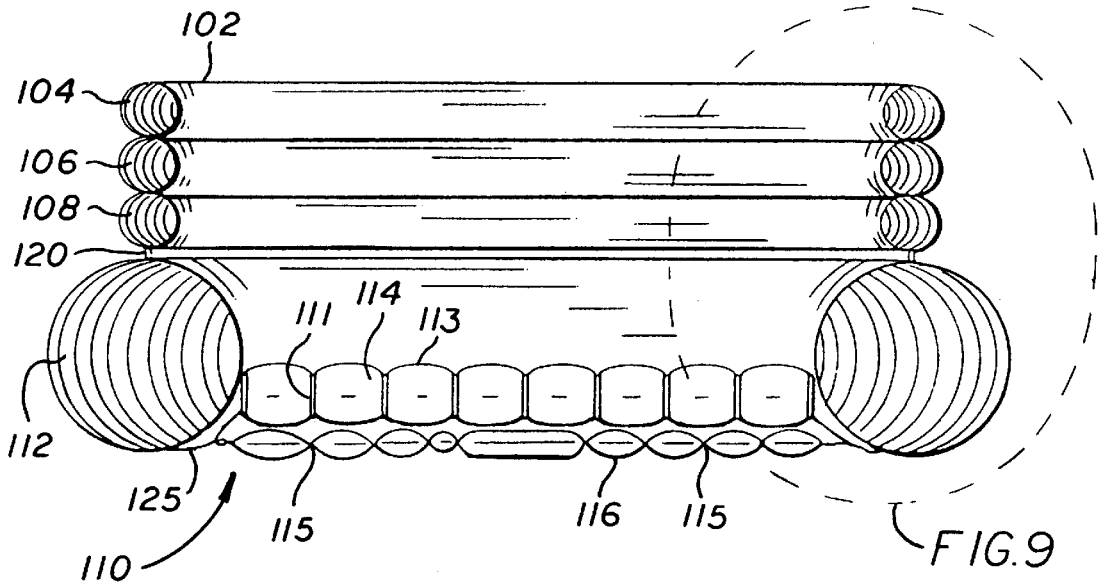
FIG. 7 is a cross-sectional view of the inflatable jumping toy taken along the line 7—7 of FIG. 1 showing the stacked rings of the retainer wall, the torodial base tube, and the I-beam shaped upper layer and single X-beam spiral shaped lower layer of the bouncing mattress.

When forming the upper layer 114 of the bouncing mattress 110, the I-beam construction shown in FIGS. 7 and 9 and in Fig. 4 is accomplished in the following manner. Two flat sheets (not shown separately) of an appropriate vinyl material such as, for example, 21 gauge polyvinylchloride, are positioned one on top of the other. A third vinyl member (not shown separately) is then fashioned in long strips of approximately 3" in height, 5" in width and 48" in length. The third vinyl member is then positioned in between and RF sealed to each of the two flat vinyl sheets in a press so that the resulting construction resembles an "I-beam"111 as clearly shown in FIGS. 57 and 9. Several I-beams 111 formed in parallel create a plurality of parallel rectangular channels 113. When the I-beam channels 113 also shown in FIGS. 7 and 9 are charged with air, the top and bottom of each channel 113 tends to round out. In the cross-sectional views provided, FIGS. 6 and 8 (taken along line 6—6 of FIG. 1) show a side view of the I-beam layer. However, FIGS. 7 and 9 (taken along line 7—7 of FIG. 1) show an end view of the I-beam channels 113 . The I-beam construction of the upper layer 114 is shown positioned within the open area of the torodial base tube 112 in FIG. 4.

The I-beam construction is employed for the upper layer 114 of the bouncing mattress 110 because it provides a level surface for children to jump upon, provides a thicker cushion to absorb the impact of the children striking the bouncing mattress 110, and provides a better distribution of the weight of the children. The I-beam 111 provides a more robust construction because each of the channels 113 are open at the end (e.g., not sealed) and thus are tied together (see FIGS. 7 and 9). Thus, air can pass around the end of each channel 113, e.g., from channel-to-channel, so that the air distribution (psi) can be more evenly spread across the channels 113 as a function of the weight load. When correct air pressure is observed in the upper layer 114 of the bouncing mattress 110, weight applied on one side of the bouncing mattress 110 will cause some deflation on that side while charging the opposite side with more air.

Figure 5:
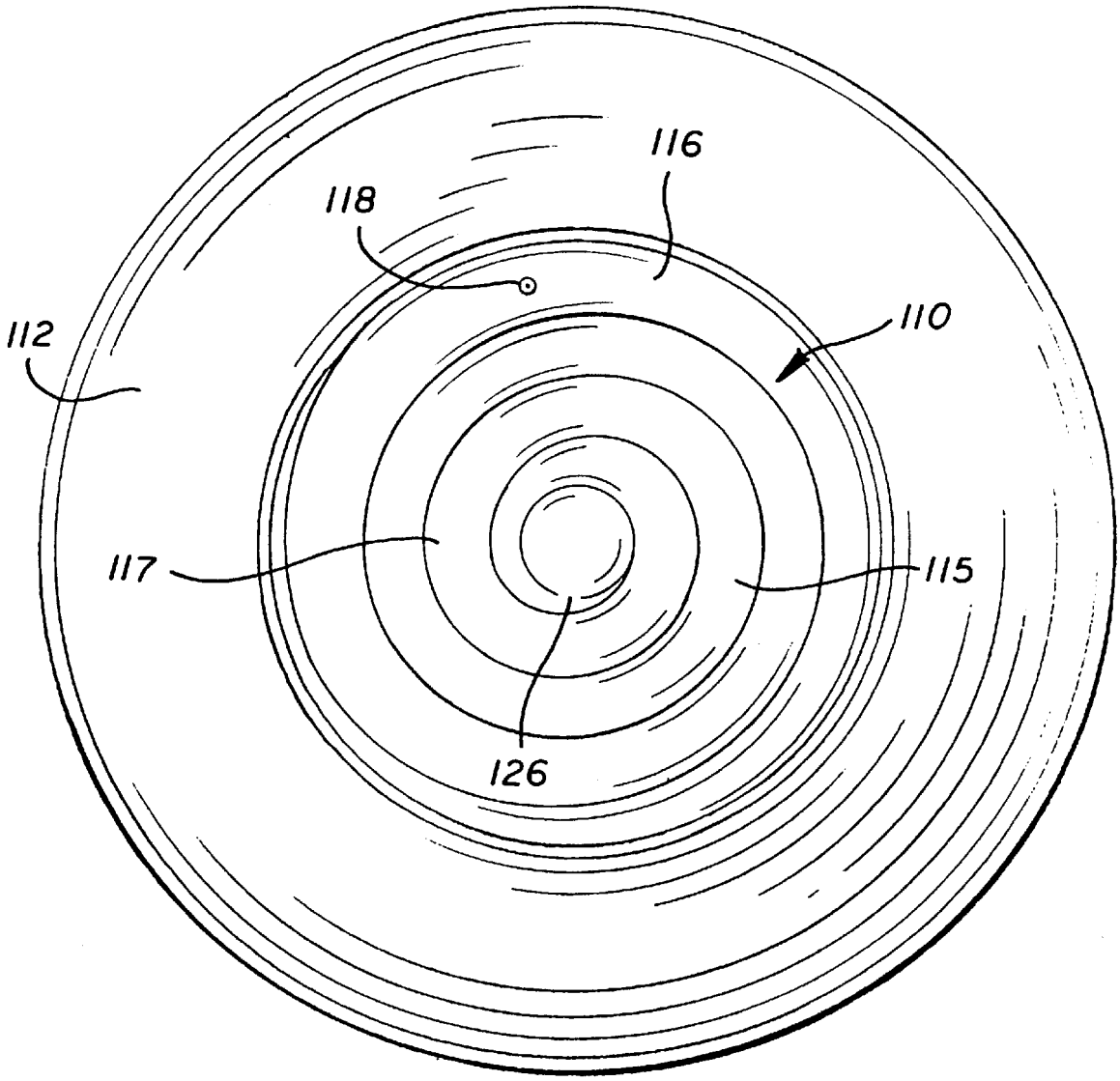
FIG. 5 is a bottom planar view of the inflatable jumping toy of FIG. 1 showing the bottom surface of the torodial base tube and the single X-beam spiral shaped lower layer of the bouncing mattress positioned within the torodial base tube.

When forming the lower layer 116 of the bouncing mattress 110, the single X-beam spiral construction shown best in FIGS. 6 and 9 and in FIG. 5 is accomplished in the following manner. A special die-platen combination is formed in the shape of a spiral. Two flat sheets (not shown separately) of the 21 gauge polyvinylchloride are positioned one on top of the other. The die-platen combination is used to apply a spiral-shaped RF weld 115 to the two flat sheets to create the single X-beam spiral construction as is clearly shown in FIGS. 5–9. A gap 126 is located at the center of a continuous spiral of the single X-beam spiral 117 construction of the lower layer 114 shown in FIG. 5. The gap 126 serves to provide an opening to enable air to enter and thus inflate the center portion of the continuous spiral 117. Because of the spiral construction, each of a plurality of adjacent air pockets 128 of the sections of the continuous spiral 117 shown in the cross-sectional views of FIGS. 6 and 7 are not the same height or size. The single X-beam spiral construction of the lower layer 116 is shown positioned within the open area of the torodial base tube 112 in FIG. 5.

The single X-beam spiral construction is employed for the lower layer 116 of the bouncing mattress 110 because of its strength. This construction is strong because the single spiral RF weld 115 is continuous and does not have multiple ends which are typically the weak point of the weld. Thus, the single X-beam spiral construction is ideal for the lower layer 116 of the bouncing mattress 110 to resist wear. Consequently, the single continuous spiral 117 supports more weight since the stress is spread more evenly over the continuous RF weld. Further, the spiral construction promotes the inherent movement of air through the continuous spiral 117 formed by the welds 115 of the die-platen combination.

During use of the inflatable jumping toy 100, a child is positioned on the bouncing mattress 110 and within the periphery of the torodial base tube 112 and the retainer wall 102. Upon execution of the jumping exercises, the child propels herself upward by applying a force from her legs downward against the bouncing mattress 110. The child's body is then lifted into the air and gravity returned to the bouncing mattress 110. Upon striking the bouncing mattress 110, the upper layer 114 having the I-beam construction absorbs the impact of the child's weight and dissipates the downward force across the plurality of I-beam channels 113. Those forces not entirely dissipated by the I-beam channels 113 are transferred to the lower layer 116. The X-beam spiral construction of the lower layer 116 having the continuous spiral 117 ensures easy passage of the air therethrough for supporting the weight of the child. Further, the three tubular shaped rings 104, 106 and 108 and the torodial base tube 112 are arranged to absorb the impact of a child colliding with the retainer wall 102. Likewise, the retainer wall 102 is designed to prevent a child from either falling out of or accidentally being ejected from the jumping toy 100. The seating shelf 124 can be used to rest once the child completes the jumping exercises.

Figure 10:
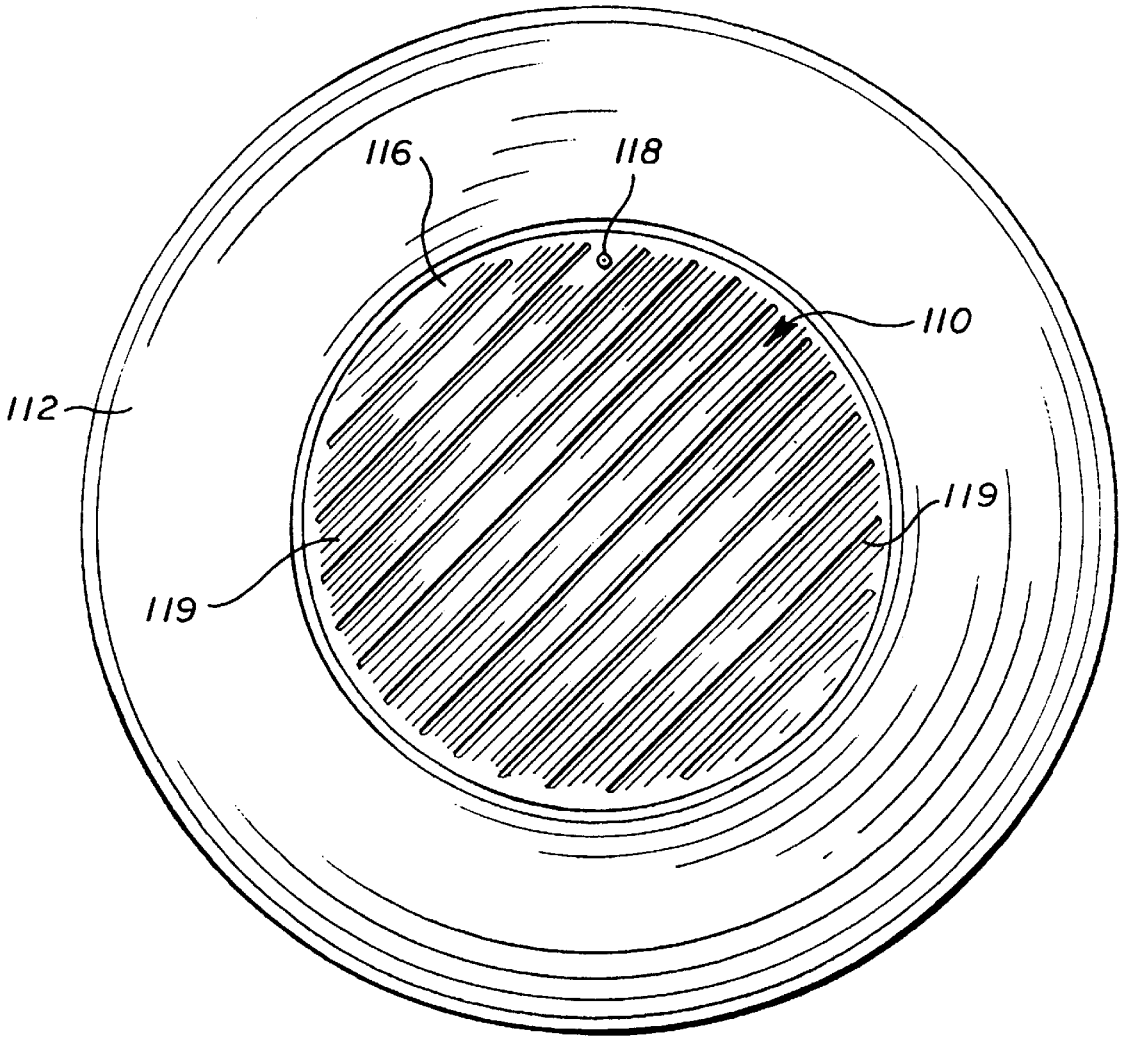
FIG. 10 is a bottom planar view of the inflatable jumping toy of FIG. 1 showing the bottom surface of the torodial base tube and an alternative parallel X-beam lower layer of the bouncing mattress positioned within the torodial base tube.
Figure 11:
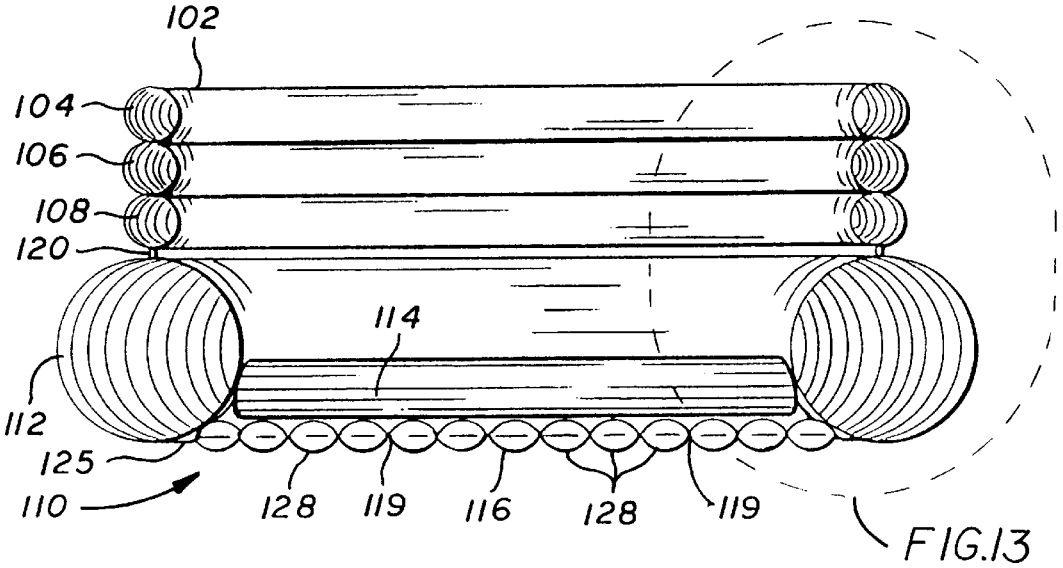
FIG. 11 is a cross-sectional view of the inflatable jumping toy taken along the line 6—6 of FIG. 1 showing the stacked rings of the retainer wall, the torodial base tube and the parallel X-beam lower layer of the bouncing mattress.
Figure 12:
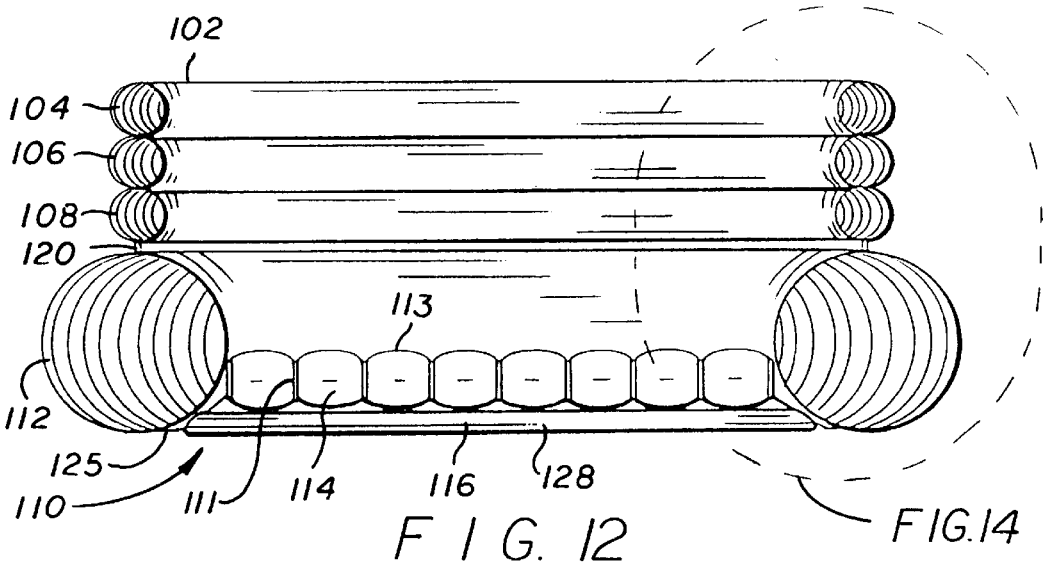
FIG. 12 is a cross-sectional view of the inflatable jumping toy taken along the line 7—7 of FIG. 1 showing the stacked rings of the retainer wall, the torodial base tube, and the I-beam shaped upper layer of the bouncing mattress.

The bouncing mattress 110 of the jumping toy 100 comprises the I-beam constructed upper layer 114 and the single X-beam spiral constructed lower layer 116. As an alternative, the lower layer 116 can comprise a parallel cross-beam or X-beam construction as shown in FIGS. 10–14. A bottom planar view of the jumping toy 100 showing the bottom surface of the torodial base tube 112 and the lower layer 116 of the bouncing mattress 110 is shown in FIG. 10. In this view, the lower layer 116 comprises the alternative construction having a plurality of X-beam welds 119 shown best in FIGS. 10, 11, and 13 fashioned in a parallel configuration.

Figure 13:
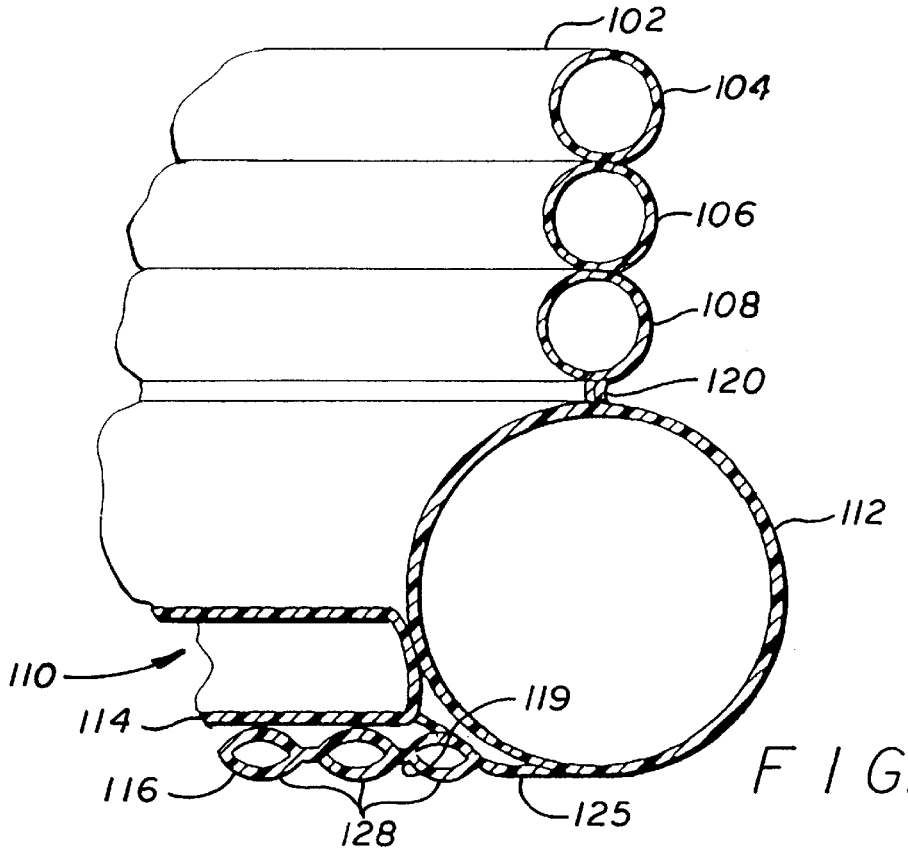
FIG. 13 is an enlarged detail drawing of the retainer wall, torodial base tube and the upper and lower layers of the bouncing mattress shown in FIG. 11.
Figure 14:
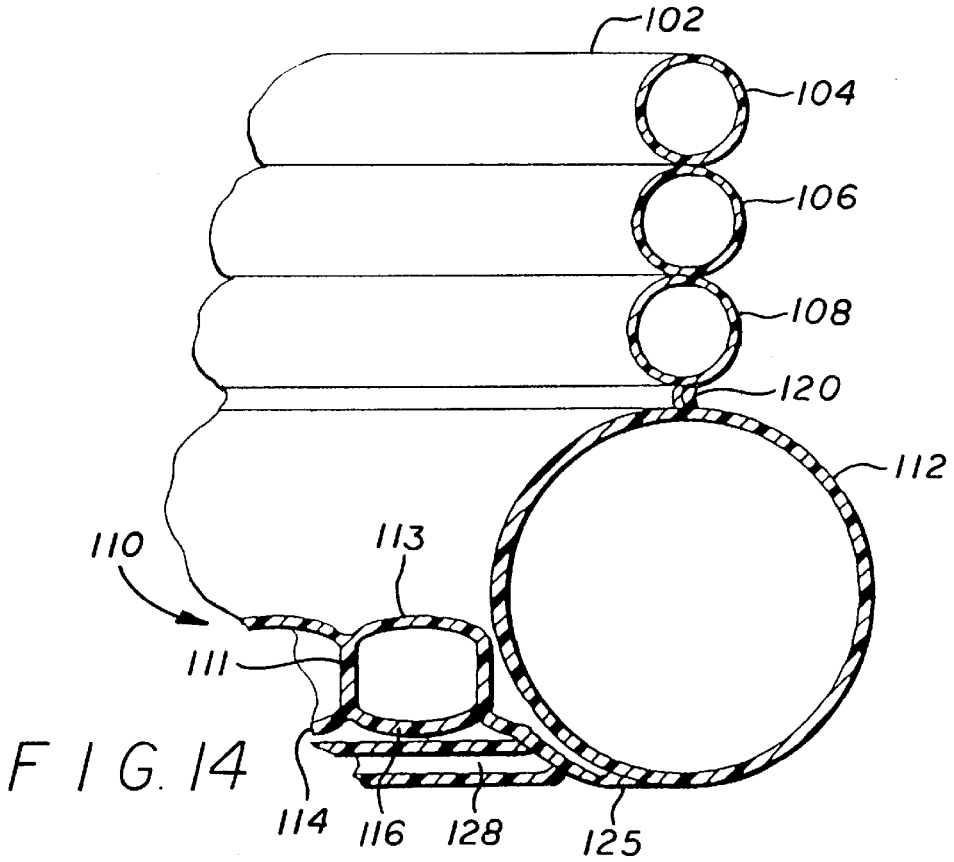
FIG. 14 is an enlarged detail drawing of the retainer wall, torodial base tube and the upper and lower layers of the bouncing mattress shown in FIG. 12.

In the cross-beam or X-beam construction, two flat sheets (not shown separately) of the 21 gauge polyvinylchloride are positioned one on top of the other. Using an appropriate die-platen combination, the sheets are welded together to form the plurality of parallel X-beam welds 119. When the resulting welded sheets are charged with air, the adjacent air pockets 128 have the appearance of a "X" and thus are referred to as a cross-beam or X-beam construction. This feature can clearly be seen in the cross-sectional view of FIG. 11 taken along the line 6—6 of FIG. 1. FIG. 13 is an enlarged detail view of the right side of FIG. 11. It can be seen in both FIGS. 11 and 13 that the interface between the plurality of adjacent air pockets 128 of the lower layer 116 forms a cross-beam or "X". The remainder of the construction shown in FIGS. 10–14 is the same as that shown in FIGS. 1–9 of the preferred embodiment of the jumping toy 100.

An alternative embodiment of the inflatable jumping toy is now presented in FIGS. 15–21 and will be identified by the reference number 200. Each element in the alternative embodiment of the jumping toy 200 which corresponds to a duplicate element of the preferred embodiment will be identified by the equivalent number of the 200 series.

Figure 15:
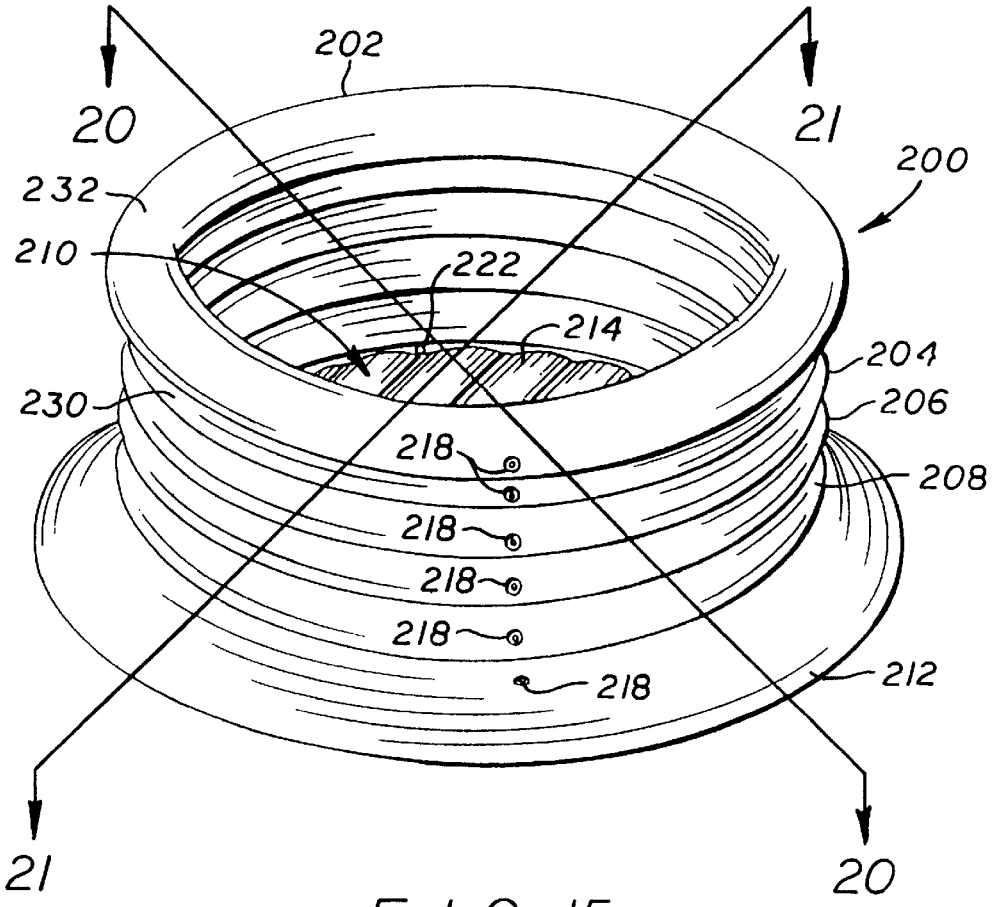
FIG. 15 is a front top perspective view of an alternative embodiment of the inflatable jumping toy of the present invention showing a vertical retainer wall comprised of stacked rings mounted upon a torodial base tube.
Figure 16:
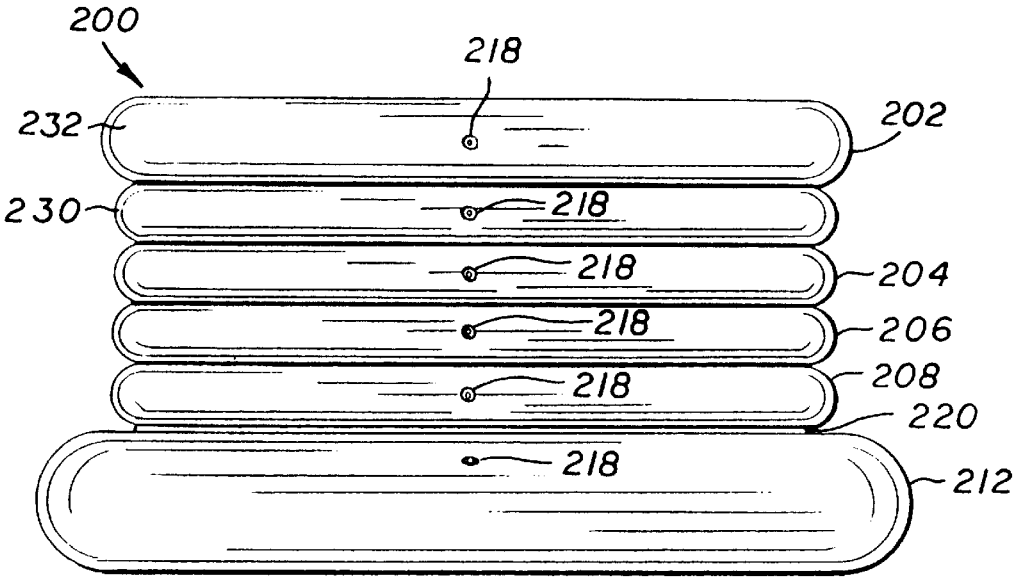
FIG. 16 is a front elevational view of the inflatable jumping toy of FIG. 15 showing an air valve mounted in each of the stacked rings of the retainer wall and in the torodial base tube.
Figure 17:
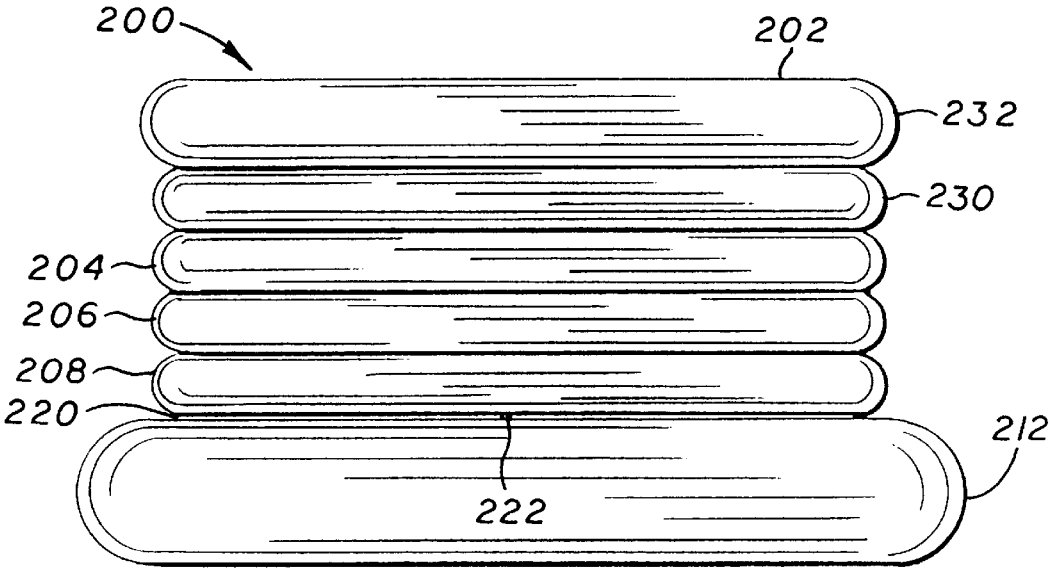
FIG. 17 is a rear elevational view of the inflatable jumping toy of FIG. 15 showing a drain hole formed in a connection web positioned between the retainer wall and the torodial base tube.
Figure 18:
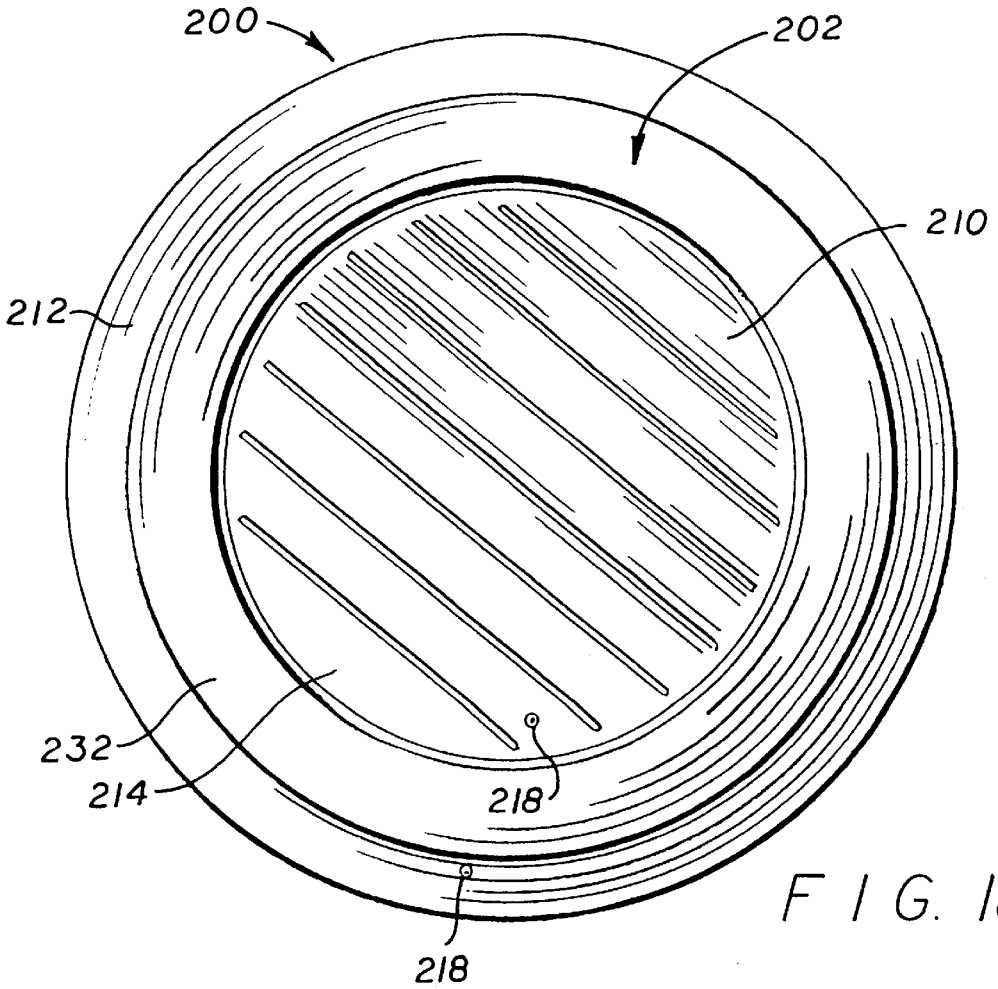
FIG. 18 is a top planar view of the inflatable jumping toy of FIG. 15 showing the retainer wall mounted over the torodial base tube and the upper layer of a bouncing mattress positioned within the torodial base tube.

The construction of the jumping toy 200 is very similar to that of the apparatus disclosed in the preferred embodiment. In particular, the jumping toy 200 includes a vertical retainer wall 202 having a plurality of tubular rings stacked vertically one upon the other as can be seen in FIGS. 15–17. Additionally, the retainer wall 202 is affixed to a torodial base tube 212 by a connection web 220 as shown in FIGS. 16–17 and 20–21. The connection web 220 includes a plurality of drain holes 222 as shown in FIG. 15 to prevent the jumping toy 200 from accumulating water. Further, mounted within the open center space of the torodial base tube 212 is a bouncing mattress 210 clearly shown in FIGS. 18–21.

The overall size of the jumping toy 200 is somewhat smaller than that disclosed in the preferred embodiment since it is intended to be used by younger children. However, the retainer wall 202 includes a plurality of five tubular vertically-stacked rings to provide more protection against falling out of or being accidentally ejected from the jumping toy 200. In addition to the three stacked rings 204, 206 and 208 corresponding to those of the preferred embodiment, stacked rings 230 and 232 are also included. Stacked ring 232 is the top ring of the retainer wall 202 and is oversized in order to provide additional cushioning.

The torodial base tube 212 of the jumping toy 200 inflates to a diameter of 55" (e.g., 4' 7" or 140 cm) to provide extra stability as is clearly shown in FIGS. 15–17. The diameter of the torodial base tube 212 is greater than the diameter of the oversized stacked ring 232 which can be seen in FIGS. 15–21 and particularly in FIG. 18. It is also noted that the jumping toy 200 does not include a seating shelf as does the preferred embodiment. The jumping toy 200 includes eight separate air chambers each with a corresponding double valve 218. The separate air chambers are located as follows. Each of the five vertical-stacked rings 204, 206, 208, 230 and 232 comprise a separate air chamber. Also, the torodial based tube 212 and the upper layer 214 and lower layer 216 of the bouncing mattress 210 each include a separate air chamber.

Figure 19:
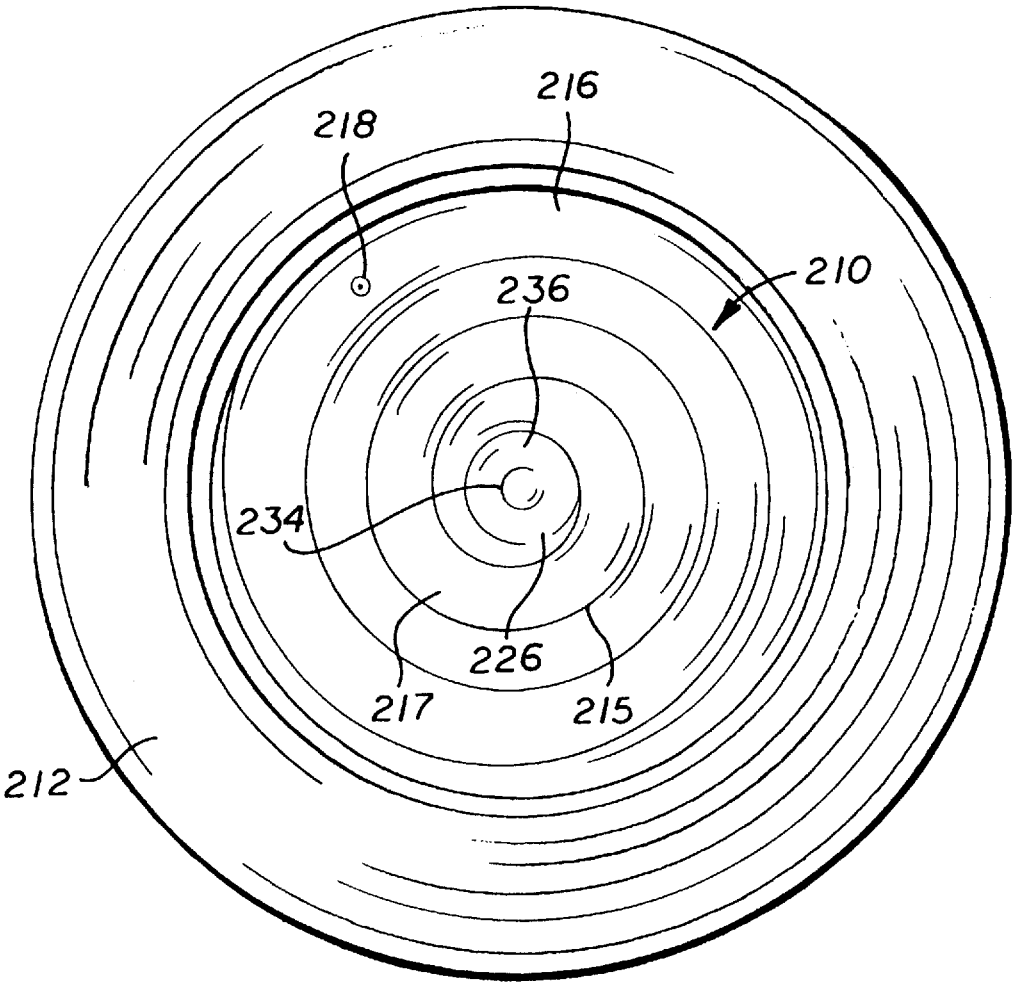
FIG. 19 is a bottom planar view of the inflatable jumping toy of FIG. 15 showing the bottom surface of the torodial base tube and the single X-beam spiral shaped lower layer of the bouncing mattress positioned within the torodial base tube.
Figure 20:
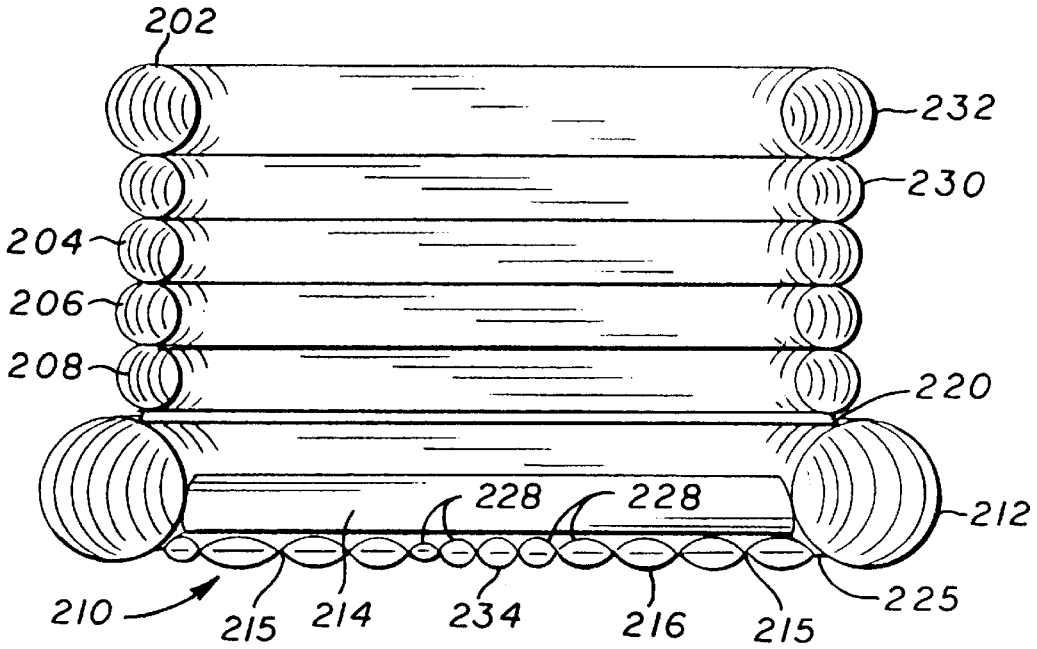
FIG. 20 is a cross-sectional view of the inflatable jumping toy taken along the line 20—20 of FIG. 15 showing the stacked rings of the retainer wall, the torodial base tube and the single X-beam spiral shaped lower layer of the bouncing mattress.
Figure 21:
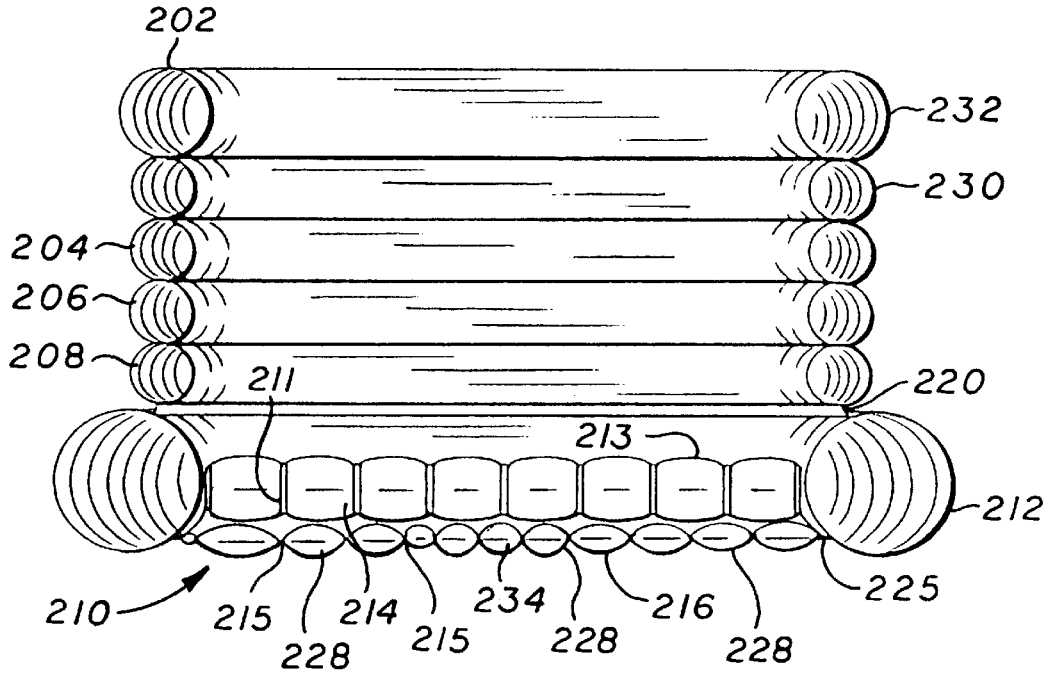
FIG. 21 is a cross-sectional view of the inflatable jumping toy taken along the line 21—21 of FIG. 15 showing the stacked rings of the retainer wall, the torodial base tube, and the I-beam shaped upper layer and single X-beam spiral shaped lower layer of the bouncing mattress.

The bouncing mattress 210 of the jumping toy 200 comprises the identical construction as that disclosed in FIGS. 5–9 of the preferred embodiment previously discussed with one exception. The upper layer 214 is comprised of the I-beam construction which is configured and operates in a manner duplicate to that previously described and as disclosed in FIGS. 18 and 20–21. The lower layer 216 of the bouncing mattress 210 is comprised of the single X-beam spiral construction previously described and as shown in FIGS. 19–21. In addition to the elements recited in the description of the X-beam spiral constructed lower layer 116 shown in FIGS. 5–9 of the preferred embodiment, the lower layer 216 of the jumping toy 200 includes a center circular seal 234 having a gap 236 formed therein as shown in FIG. 19. The gap 236 serves to enable air to enter and exhaust from the circular seal 234. The remainder of the jumping toy 200 is constructed and operates in a manner duplicate to that described in the preferred embodiment of the jumping toy 100 of the present invention.

It is noted that each of the embodiments 100 and 200 of the inflatable jumping toy disclosed herein are constructed of durable vinyl. One such vinyl is S-80 resin which is a high molecular weight polyvinylchloride that is unaffected by oil, grease or the like. This vinyl is highly resistant to damage from abrasion, impact and sunlight and is designed to withstand higher air pressures for ensuring greater rigidity. The embodiments 100 and 200 of the jumping toy can be inflated with a regular toy inflation pump and can be deflated to approximately one cubic foot for convenient storage. The torodial base tube 112 employed in the present invention is used to ensure stability during use of the jumping toy 100. Although not shown in the drawing Figs., the bottom surface of the torodial base tube 112 can include a traction element to improve the grip of the jumping toy 100 to the indoor or outdoor surface upon which the jumping toy 100 is placed.

It will be apparent from the foregoing that, while particular forms of the invention have been illustrated and described, various modifications can be made without departing from the spirit and scope of the invention. Accordingly, it is not intended that the invention be limited, except as by the appended claims. Accordingly,

What is claimed is:

1. An inflatable jumping toy comprising:

a torodial base tube for providing a base to a jumping toy;

retainer means vertically mounted on and connected to a top surface of said base tube for preventing accidental ejection from said jumping toy;

top bouncing means surrounded by and connected to a bottom surface of said base tube for providing impact absorption during use of said jumping toy; and bottom bouncing means surrounded bv and connected to said bottom surface of said base tube for providing wear resistance to said jumping toy, wherein said top bouncing means and said bottom bouncing means each being separate from said retainer means.

2. The inflatable jumping toy of claim 1 wherein said retainer means comprises a vertical retainer wall.

3. The inflatable jumping toy of claim 1 wherein said retainer means is comprised of a plurality of separate inflatable rings.

4. The inflatable jumping toy of claim 1 wherein said top bouncing means and said bottom bouncing means each comprise an air filled mattress layer.

5. The inflatable jumping toy of claim 1 wherein said top bouncing means comprises an I-beam construction.

6. The inflatable jumping toy of claim 1 wherein said bottom bouncing means comprises an X-beam spiral construction.

7. The inflatable jumping toy of claim 6 wherein said X-beam spiral construction comprises a single X-beam welded seal formed in a continuous spiral.

8. The inflatable jumping toy of claim 1 wherein said bottom bouncing means comprises a parallel X-beam construction.

9. The inflatable jumping toy of claim 1 wherein said retainer means, said torodial base tube and said top bouncing means and said bottom bouncing means each include a double air valve.

10. The inflatable jumping toy of claim 1 wherein said retainer means is attached to said torodial base tube by a connection web.

11. The inflatable jumping toy of claim 1 further including a plurality of drain holes for preventing the accumulation of water.

12. The inflatable jumping toy of claim 1 wherein the diameter of said torodial base tube is greater than the diameter of said retainer means for providing stability in said jumping toy.

13. The inflatable jumping toy of claim 1 further including a seating shelf extending inward from said torodial base tube for providing a seat within said jumping toy.

14. An inflatable jumping toy comprising:

a torodial base tube for providing a base to a a jumping toy;

a vertical retainer wall mounted on and connected to a top surface of said base tube for preventing accidental ejection from said jumping toy;

a top bouncing layer surrounded by and connected to a bottom surface of said base tube and comprising I-beam construction for providing cushioned impact absorption during use of said jumping toy; and a bottom bouncing layer surrounded by and connected to said bottom surface of said base tube and comprising single X-beam spiral construction for providing wear resistance to said jumping toy, wherein said top bouncing layer and said bottom bouncing layer each being separate from said vertical retainer wall.

15. The inflatable jumping toy of claim 14 wherein said retainer wall is comprised of a plurality of separate inflatable rings and where an uppermost positioned inflatable ring of said plurality of inflatable rings is the largest of said plurality of inflatable rings.

16. The inflatable jumping toy of claim 14 wherein said bottom bouncing layer includes a separate circular seal at the center of a single X-beam welded seal formed in a continuous spiral.

17. The inflatable jumping toy of claim 16 wherein said separate circular seal includes a gap to enable air to enter and escape from said separate circular seal.

18. An inflatable jumping toy comprising:

a torodial base tube for providing a base to a jumping toy;

a vertical retainer wall mounted on and connected to a top surface of said base tube for preventing accidental ejection from said jumping toy;

a top bouncing layer surrounded by and connected to a bottom surface of said base tube and comprising I-beam construction for providing cushioned impact absorption during use of said jumping toy; and a bottom bouncing layer surrounded by and connected to said bottom surface of said base tube and comprising parallel X-beam construction for providing wear resistance to said jumping toy, wherein said top bouncing layer and said bottom bouncing layer each being separate from said vertical retainer wall.

19. The inflatable jumping toy of claim 1 wherein said top bouncing means and said bottom bouncing means are connected together and to said bottom surface of said base tube at a connection point by heating sealing.

* * * * *